United States Patent [19]

Bisbing et al.

[11] 4,026,588

[45] May 31, 1977

[54] PUSH-TO-OPEN MAGNETIC CATCH

[75] Inventors: Robert H. Bisbing, Springfield; James H. Vickers, Media, both of Pa.

[73] Assignee: Southco, Inc., Concordville, Pa.

[22] Filed: June 15, 1976

[21] Appl. No.: 696,180

[52] U.S. Cl. ..... 292/251.5

[51] Int. Cl.[2] ..... E05C 19/16

[58] Field of Search ..... 292/DIG. 4, DIG. 72, 292/251.5

[56] References Cited

UNITED STATES PATENTS

| | | | |
|---|---|---|---|
| 84,771 | 12/1868 | Shannon | 16/168 |
| 1,370,681 | 3/1921 | Bloxsom | 292/336 |
| 1,783,711 | 12/1930 | Hanny | 292/202 X |
| 2,673,111 | 3/1954 | Teetor | 292/251.5 |
| 3,934,909 | 1/1976 | Van Natter | 292/251.5 |

FOREIGN PATENTS OR APPLICATIONS

| | | | |
|---|---|---|---|
| 1,254,687 | 1/1961 | France | 292/251.5 |

*Primary Examiner*—Richard E. Moore
*Attorney, Agent, or Firm*—Paul & Paul

[57] ABSTRACT

A push-to-open magnetic catch for cabinet doors and the like has a housing and within the housing is a rectangular magnet mounted at one end of a pivotal lever. The housing is ordinarily so positioned within the cabinet that the forward edge of the magnet projects forwardly of the cabinet to receive and make magnetic contact with the closing door or with an armature plate mounted thereon. In normal closed position, an overtravel space exists between the inner surface of the door or armature plate and the cabinet. The lever has a forward edge so contoured that when, to open, the closed door is pushed inwardly into the overtravel space, the lever is cammed pivotally inwardly, thereby pulling the magnet inwardly along a line or path guided by the housing. This separates the magnet from the door, and allows the force of a spring-loaded plunger, which has been pushing outwardly against the door, to push the door outwardly when the inward force is removed. When the plunger thus moves outwardly, it contacts the rearward edge of the lever and pushes it forwardly, to a limit position, thereby returning the magnet to its original position. A frictional detent arrangement, keeps the magnet in its proper position while the door is being moved toward, or away from, the magnet.

11 Claims, 11 Drawing Figures

PUSH-TO-OPEN MAGNETIC CATCH

BACKGROUND OF THE INVENTION

This invention relates to latches or catches for cabinets and the like.

The invention relates particularly to a catch of the "push-to-open" type. This type is also sometimes referred to as the "invisible" type, since no hardware is mounted on the outside surface of the cabinet or other closure to which the catch is applied.

Prior art catches of the "push-to-open" or "invisible" types have included both mechanical and magnetic catches. However, the mechanical catches of this type have been subject to jamming and/or failure to close due to minor misalignment. And, if a mechanical catch of this type fails to release, it cannot be repaired or replaced without damaging the cabinet to remove the catch.

Magnetic catches have the advantage that if a component should break, or the catch should jam, the door can be opened without damaging or destroying the door. The prior art magnetic catches of the "push-to-open" type have included complicated mechanisms to reduce the magnetic field by moving the pole pieces with respect to the magnet. A magnetic catch of this type is described in Hutchinson U.S. Pat. No. 3,492,037. However, the Hutchinson magnetic catch has a disadvantage in that the catch is subject to overtravel when being fastened, in which case the door may be inadvertently released.

A magnetic catch of the "push-to-open" type is also shown in Teetor U.S. Pat. No. 2,673,111. However, the Teetor magnetic catch operates in only one position with respect to gravity, so that it may be mounted only on a vertical door jam. Moreover, after opening the door, the magnetic catch is not always fully returned to the position where it may contact the door upon its next closing. These are two disadvantages of the Teetor catch.

SUMMARY OF THE INVENTION

An object of the present invention is to provide a "push-to-open" magnetic catch that operates effectively when mounted in any position with respect to gravity.

A further object is to provide a magnetic catch of the above type which is returned fully to a position to contact the door at the next closing.

A further object is to provide a magnetic catch of the foregoing type which resists inadvertent overtravel by requiring a force to release the magnet which is much greater than the force required to bring the door into magnetic engagement.

DETAILED DESCRIPTION OF THE PREFERRED EMBODIMENTS

Figure 1:
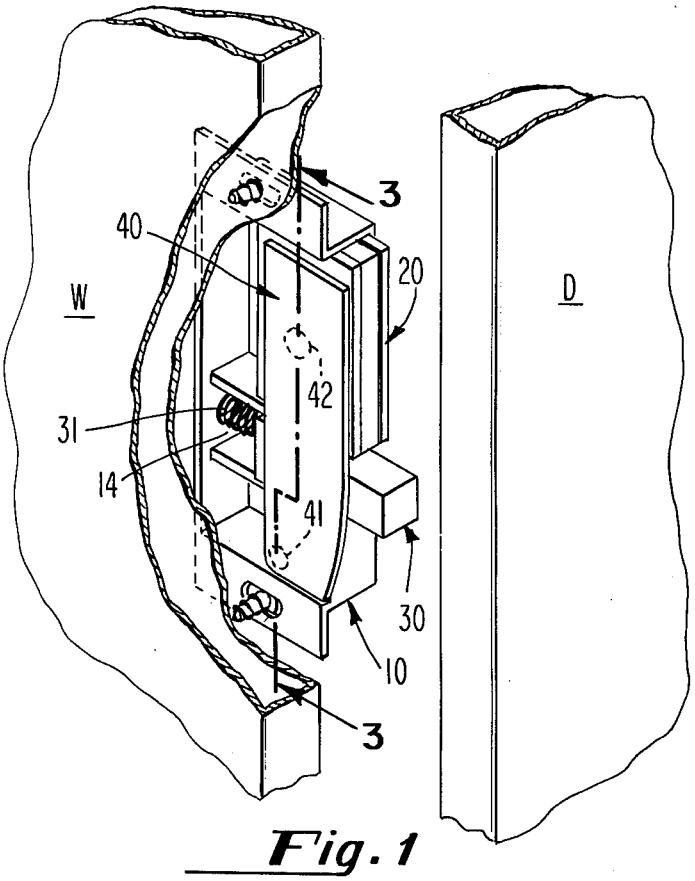
FIG. 1 is a perspective illustration showing the magnetic catch of the present invention mounted on a cabinet wall which is partly cut away to reveal the catch more fully.

Referring now to FIG. 1, a "push-to-open" magnetic catch according to the present invention is shown mounted on the wall W of a cabinet or the like in a position to latch a door D or other closure element. In FIG. 1, a portion of the cabinet wall W is cut away to show more fully the "push-to-open" magnetic catch. If door D is of non-magnetic material, a strike of magnetic material is applied by means of adhesive or suitable fasteners to the door in a position aligned with the pole pieces of the magnet of the catch.

Figure 2:
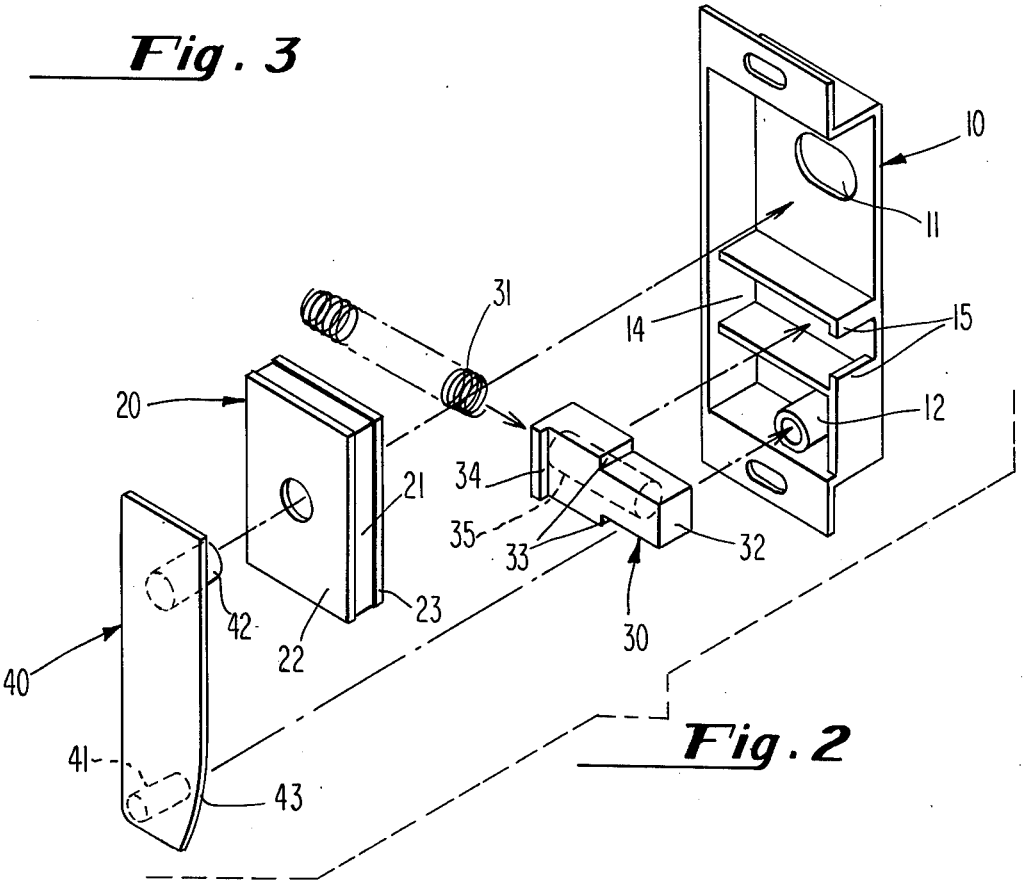
FIG. 2 is an exploded view of the magnetic catch of FIG. 1.

As seen most clearly in the exploded view of FIG. 2, the magnetic catch of the present invention comprises a compartmented housing 10 screwed or otherwise secured to the wall W of the cabinet. Housing 10 may have a configuration such as is shown in FIG. 2. A tubular boss 12 in the lowermost compartment receives a pivot stud 41 of a plate lever 40. Plate lever 40 is of generally rectangular shape but its forward edge surface, at the lower end portion thereof, is contoured as shown, to form a camming surface, for a reason which will become clear. The upper portion of plate lever 40 is provided with a pin 42 the nose of which projects into a slot 11 in the uppermost compartment of housing 10. A sandwich type magnet 20, comprising a center magnet 21 and pole pieces 22 and 23, is pivotally supported on pin 42. The forward or outward portion of the uppermost compartment is fully open. Forward movement of magnet 20 is limited by pin 42 in slot 11.

Figure 3:
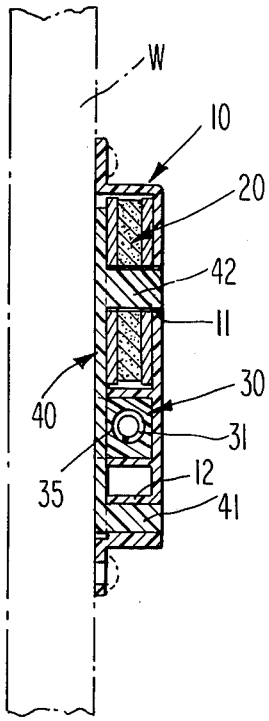
FIG. 3 is a view, in section, looking along the line 3—3 of FIG. 1.

Magnet 20 is rectangular and the walls of the rectangular uppermost compartment of housing 10, as viewed in FIGS. 1–3, function to guide the magnet 20 when lever 40 is pivotally moved. This serves to keep magnet 20 is such position that the forward edges of the pole pieces 22–23 are always nearly parallel with the forward edge of housing 10 and with the surface of the door D during pivotal movement of the lever 40. Sufficient clearance is provided around the edges of the magnet that it may rotate slightly to mate with a slightly misaligned door.

Mounted within a center compartment 14 of housing 10 is a plunger 30 which is biased forwardly by a compression spring 31 which is received within bore 35 of the plunger. The forward portion of center compartment 14 is partially closed forming a rectangular opening defined by upper and lower shoulders 15. Plunger 30 has a square nose 32 and rearwardly thereof a pair of shoulders 33 adapted to abut against shoulders 15 of compartment 14 when the nose 32 of the spring-loaded plunger is projected through the opening to its forwardmost limit position. In this limit position, the foremost end of nose 32 is well beyond the forward edge of the housing 10. Plunger 30 also has a rear step 34 which is adapted to bear against the rear edge of lever 40.

Figure 4:
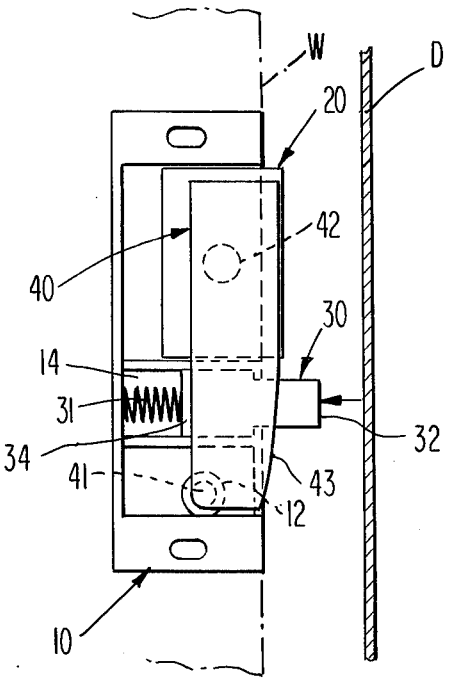
FIG. 4 illustrates the magnetic catch on the cabinet wall prior to door closing.
Figure 5:
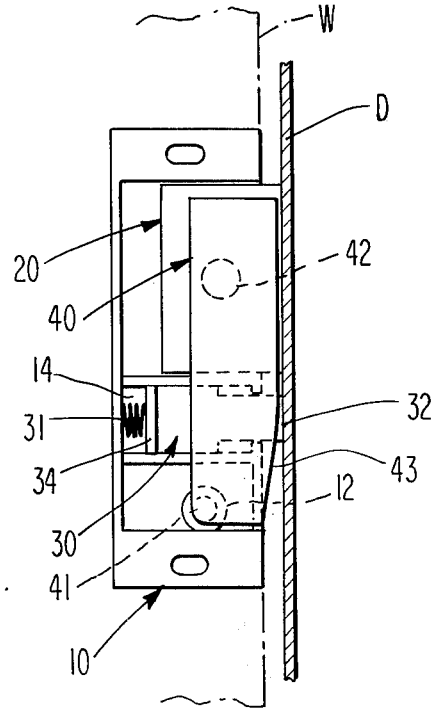
FIG. 5 is an illustration showing the door in closed latched position.
Figure 6:
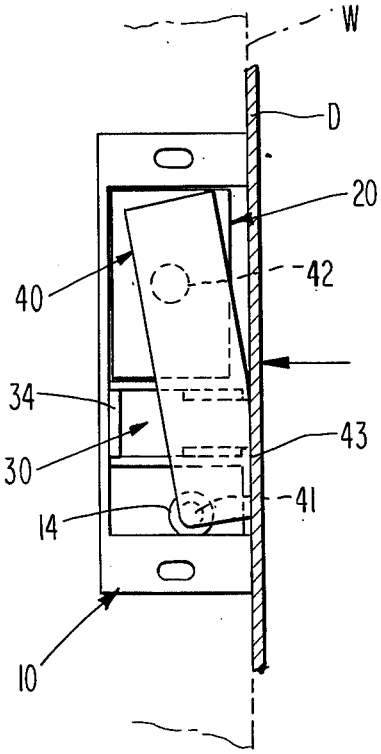
FIG. 6 is an illustration showing the door pushed inwardly in the first stage of the unlatching or opening operation.
Figure 7:
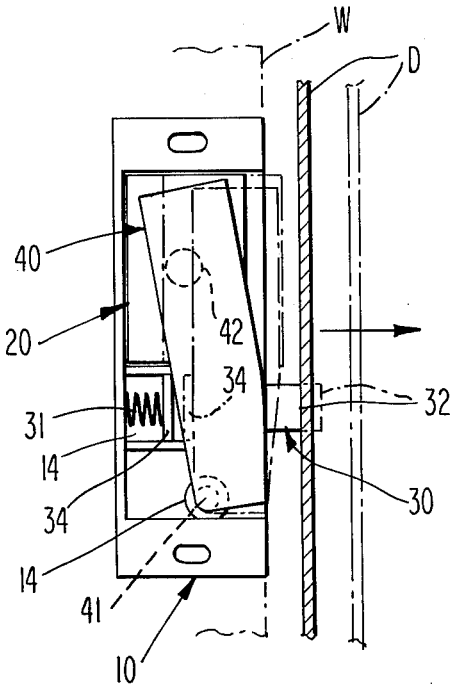
FIG. 7 is an illustration showing the door being urged outwardly to open position by the plunger of the catch while the magnet remains in its inward position.

Referring now to FIGS. 4–7, these figures illustrate the magnetic "push-to-open" catch of the present invention in various conditions of operation. In FIG. 4, the catch is shown prior to door closing. In FIG. 5, the catch is shown with the door in closed or latched position. In FIG. 6, the catch is shown with the door pushed inwardly into the overtravel space. This action separates the magnet from the door and is the first stage of the opening or unlatching operation. In FIG. 7, the door is being urged outwardly to open position by the spring-loaded plunger 30, and lever 40 is being returned to its forward position shown in phantom in FIG. 7 and in solid line in FIG. 4.

Referring now to FIG. 4, it will be seen that, prior to closing of door D, the spring-loaded plunger 30 projects well forwardly of the front edge of the housing 10, which is also the forward edge of the cabinet wall W on which the housing 10 is mounted.

In FIG. 5, the door D has been pushed to its closed or latched position, and plunger 30 has been depressed, but the other components of the catch have not moved. In the door-closed position, there is a small overtravel space between the inner surface of the door D and the forward edge of the housing 10 and cabinet wall W. The forward edge of magnet 20 projects forwardly of the cabinet wall W and is in contact with the inner surface or armature of door D and magnetically holds the door in its closed position.

In FIG. 6, to open, the door D has been pushed inwardly into the overtravel space to a position against the forward edges of the cabinet W and housing 10. This requires a force considerably greater than the force required to close the door. This increased force is due primarily to the force required to break the magnetic attraction by lever action. A portion of the increased force is due to the further compression of spring 31.

As indicated, FIG. 6 depicts the first stage of the opening operation. It will be evident that when the door D is pushed inwardly through the overtravel space to the position shown, magnet 20, as well as plunger 30, is pushed inwardly. The initial inward movement of magnet 20 causes the lever 40 to move pivotally counterclockwise on pivot stud 41. This pulls magnet 20 away from the door D. Continued inward movement of door D brings the curved camming edge 43 of lever 40 into an abutting contact with the door and causes further pivotal counterclockwise movement of lever 40. This causes further inward linear movement of magnet 20, guided by the uppermost compartment of housing 10, and pulls magnet 20 still further from door D, to the inward limit position shown in FIG. 6. In this position, magnet 20 is sufficiently separated from door D that the magnetic attraction is too low to overcome the detent or frictional resistance against movement of the magnet provided by the design of the present application.

FIG. 7 indicates what happens when the force which has pushed the door inwardly through the overtravel space is removed. When this happens, since the door is no longer being held by the attraction force of magnet 20, the plunger 30, pushed outwardly by spring 31, pushes the door outwardly away from the housing 10 and still further away from magnet 20, until the vertical step 34 at the rearward end of plunger 30 engages the rearward edge 45 of lever 40. The force of spring 31 is sufficient to push lever 40 forwardly, causing it to pivot clockwise about the pivot stud 41, and causing it to pull magnet 20 forwardly against the frictional resistance or drag which opposes its movement. The magnet is thereby moved from its innermost position, shown in FIG. 6, to an outermost limit position, shown in phantom in FIG. 7, and in solid line in FIG. 4. The outermost limit position of the magnet is defined by the abutment of shoulders 33 of the plunger against the shoulders 16 of compartment 14 of the housing.

In the latch mechanism just described, it is important that a frictional resistance or drag be provided to the movement of magnet 20 so that as the door is being closed, and the spring-biased plunger 30 is being depressed, the magnet will retain its most forward position. Also, when the push-to-open force has been removed, it is important that the magnet remain in its rearmost position so that the door may swing open without being caught in the magnetic field of the magnet. Thereafter, the magnet may be moved forwardly, and this is what is done in the catch of the present application by the action of the spring-loaded plunger 30, pushing against the lever 40.

FIGS. 1–7 represent the catch in its most simple form. The housing 10, including the annular cylindrical boss 12, is preferably formed of molded plastic, such as acetal, and so is the lever 40, including stud 41 and pin 42. Magnet 20 may preferably be of the sandwich type having permanent magnet 21 and low carbon steel pole pieces 22,23. In the form shown in FIGS. 1–7, the required frictional resistance or drag to the movement of magnet 20 is provided by a light interference fit of pivot stud 41 in the bore of boss 12. Plunger 30 may also be molded plastic. Spring 31 is preferably stainless steel.

Figure 8:
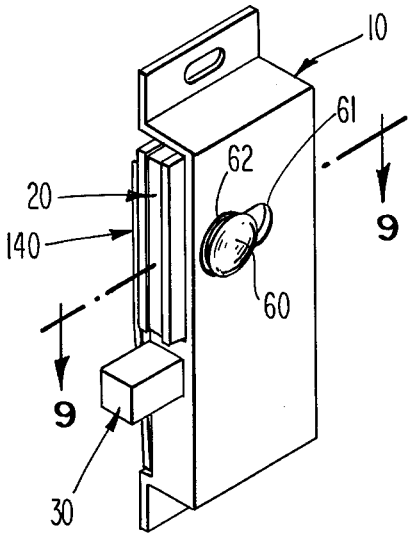
FIG. 8 is a perspective view of a modified form of magnetic catch according to the present invention.
Figure 9:
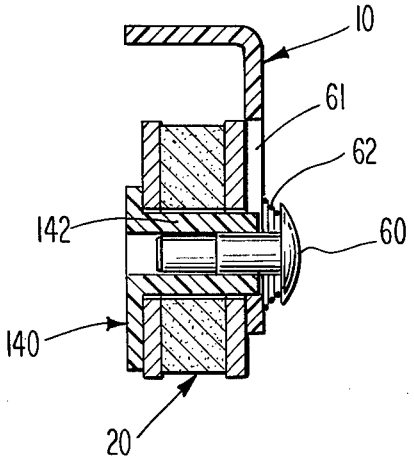
FIG. 9 is a view, in section, looking down along the line 9—9 of FIG. 8.

FIG. 8 and 9 represent an alternate design directed to an alternate way of providing the necessary frictional drag to the movement of magnet 20. In FIGS. 8–9, the molded plastic lever 140 is provided with an annular boss 142 which projects forwardly from lever 140 at the position of, and in lieu of the pin 42 of lever 40 shown in the FIGS. 1–7 embodiment. The magnet is supported on the boss 142 and a headed pin 60, preferably of aluminum, is inserted with a tight fit into boss 142 through a slot 61 in the front face of housing 10. Provided under the head of pin 60 is a spring 62 which urges pin 60 outwardly. However, the tight fit between pin 60 and the inner surface of boss 142 maintains the pin tightly in the boss. As seen best in FIG. 9, the outward force of spring 62 pulls lever 140 and magnet 20 toward housing 10, thereby providing the frictional drag required. Spring 62 is preferably a compressed conical spring with its largest coil against the housing 10 to provide good bearing about the slot 61.

Figure 10:
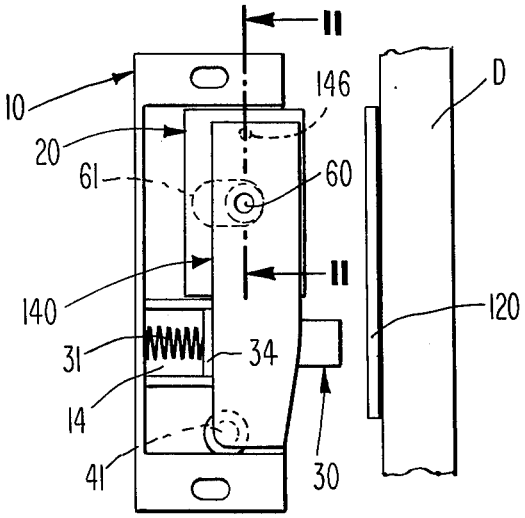
FIG. 10 is an illustration of another modification according to the present invention.
Figure 11:
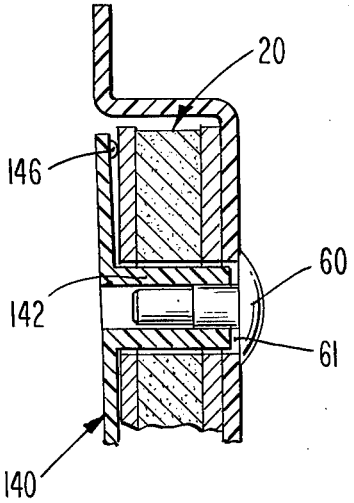
FIG. 11 is a view, in section, looking along the line 11—11 of FIG. 10.

FIGS. 10–11 represent another alternate design for providing a desired frictional drag against movement of the magnet. The design in FIGS. 10–11 is generally similar to that of FIGS. 8–9 but in FIGS. 10–11 the coil spring 62 is omitted and a small projection 146 is provided on the forward surface of the lever 140 at the upper end of the lever, bearing against the magnet 20. The spring characteristic of the molded plastic material of lever 140 produces the force required to urge magnet 20 against housing 10, thereby to provide the required drag.

The catch of the present invention has been illustrated and described as being installed in an upright position within a cabinet or other enclosure in a position to cooperate with a door surface, and the lever has been shown and described as being pivotal about its lower end, with its upper end carrying the magnet. These positions could, of course, be reversed. That is, the housing could be so mounted that the lever is pivoted at its upper end and the magnet carried at the lower end of the lever.

In those installations where the door D is made of wood or other non-magnetic material, an adhesively-backed strike of magnetic material is affixed to the door. Such a strike is shown in FIG. 10, identified 120.

While mounting the housing and its magnetic catch assembly on the cabinet, rather than on the door, is preferred, it would, of course, be possible to mount the housing and its magnetic catch assembly on the door, with a strike surface being mounted on the cabinet or other frame.

The housing need not be mounted in an upright position. So far as its operation is concerned, the housing and its magnetic catch assembly could be mounted horizontally or in any other position relative to gravity.

In summary, it will be seen that the "push-to-open" catch of the present invention has a magnet pivotally mounted on a pivotal lever. The magnet is rectangular and is contained within a rectangular compartment of a housing which guides the magnet along a linear path as the lever is pivotally moved. A spring-loaded plunger acts to urge the door open after the magnetic attraction has been severed by a push-to-open force and then further acts to return the lever and the magnet which it carries to a position at which the magnet again receives the door. A detent or frictional drag is provided to the magnet movement so that when the door is being closed the magnet will not move, and so that when the magnet is pulled away from the door or armature plate by the push-to-open force, the magnet will remain in a remote position until returned to a door-receiving position by the action of the plunger. Forward movement of the magnet is limited by the magnet support pin in the slot in the housing.

What is claimed is:

1. A push-to-open magnetic catch for a cabinet door or the like, said catch comprising:

a. a housing;

b. a lever supported at one end for pivotal movement within said housing;

c. a magnet pivotally mounted on said lever at the other end thereof and adapted to be guided by said housing to be aligned to mate with the door surface when said lever is moved pivotally;

d. a spring-loaded plunger urging the door in a door-opening direction and urging said lever pivotally in a door-opening direction;

e. stop means for limiting the movement of said plunger in said door-opening direction whereby when said plunger is in said limit position said lever holds said magnet in a door-latching position and said plunger projects beyond said housing to a position to be engaged during door closing;

f. lever pivot-support means providing a frictional drag to the movement of said lever-mounted magnet for retaining said magnet in a preselected position during door closing and door opening, said means comprising:

i. a pivot stud on said lever;

ii. a boss in said housing having a bore for receiving said stud with an interference fit; and g. means limiting the forward movement of said magnet.

2. A push-to-open magnetic catch for a cabinet door or the like, said catch comprising:

a. a housing;

b. a lever supported at one end for pivotal movement within said housing;

c. said lever includes an annular boss on which said magnet is pivotally mounted;

d. said housing is provided with a slot in registry with said boss on said lever;

e. a headed pin passes through said slot and is received with a tight fit in the bore of said lever boss;

f. a magnet pivotally mounted on said lever at the other end thereof and adapted to be guided by said housing to be aligned to mate with the door surface when said lever is moved pivotally;

g. a spring-loaded plunger urging the door in a door-opening direction and urging said lever pivotally in a door-opening direction;

h. stop means for limiting the movement of said plunger in said door-opening direction whereby when said plunger is in said limit position said lever holds said magnet in a door-latching position and said plunger projects beyond said housing to a position to be engaged during door closing;

i. means providing a frictional drag to the movement of said lever-mounted magnet for retaining said magnet in a preselected position during door closing and door opening; and j. means limiting the forward movement of said magnet.

3. A magnetic catch according to claim 2 wherein:

a. a compression spring is provided under the head of said pin for urging said pin outward and pulling said magnet against said housing.

4. A magnetic catch according to claim 3 wherein:

a. said spring is a conical spring with the largest coil bearing against the wall of said housing about said slot.

5. A push-to-open magnetic catch for a cabinet door or the like, said catch comprises:

a. a housing;

b. a lever having at one end a pivot stud projecting therefrom and received within the bore of a boss of said housing;

c. magnet support means projecting from said lever remote from said pivot stud;

d. a generally rectangular magnet assembly having a central hole for receiving said support means for supporting said magnet assembly pivotally on said lever;

e. a first compartment in said housing for receiving said magnet assembly and for keeping said magnet edge parallel with mating door surface during pivotal movement of said lever;

f. a second compartment in said housing located between said first magnet-guiding compartment and said pivot-stud receiving boss;

g. a spring-loaded plunger supported within said second compartment;

h. said plunger having a forward nose portion adapted to project forwardly through an opening in the forward wall of said second compartment, said plunger having rearward shoulders for engaging the forward wall of said second compartment, thereby to limit the forward projection of said nose portion;

i. said plunger having a step portion at its rearmost end adapted, when said plunger is moved forwardly, to abut against the rearward edge of said lever for moving said lever pivotally forwardly;

j. means providing a frictional drag to the movement of said lever-supported magnet; and k. a slot in the wall of said first compartment of said housing in registry with said magnet support means for limiting the pivotal movement of said lever.

6. A magnetic catch according to claim 5 wherein said means providing a frictional drag to the movement of said lever-supported magnet assembly comprises an interference fit between said pivot stud and the bore of said boss.

7. A magnetic catch according to claim 5 wherein said means providing a frictonal drag to the movement of said lever-supported magnet assembly comprises means urging said magnet assembly against the wall of said first compartment of said housing.

8. A magnetic catch according to claim 5 wherein said magnet support means comprises:

a. a pin integral with, and projecting from, said lever into said slot in the wall of said first compartment of said housing.

9. A magnetic catch according to claim 8 wherein:

a. said support pin is an annular boss.

10. A magnetic catch according to claim 9 wherein said means for urging the magnet assembly against the wall of the first compartment of said housing comprises:

a. a headed pin inserted through said slot into the bore of said boss;

b. a coil spring is provided under the head of said headed pin for urging said pin outwardly, thereby to pull said magnetic assembly against the wall of said first compartment.

11. A magnetic catch according to claim 9 wherein said means for urging said magnetic assembly against the wall of said first compartment comprises:

a. a headed pin inserted through said slot into the bore of said boss;

b. a projection is provided on the forward surface of said lever at the end thereof remote from said pivot stud, said projection bearing against said magnet assembly to urge said magnet assembly against the wall of said first compartment.

* * * * *